US009637961B2

(12) United States Patent
Header et al.

(10) Patent No.: US 9,637,961 B2
(45) Date of Patent: May 2, 2017

(54) SLIDING DOOR ASSEMBLY

(71) Applicant: Gregory A Header, Richland, PA (US)

(72) Inventors: Gregory A Header, Richland, PA (US); Rick James Hawk, Tower City, PA (US); Glenn Jesse Davis, Muir, PA (US)

(73) Assignee: Gregory A Header, Pine Grove, PA (US)

( * ) Notice: Subject to any disclaimer, the term of this patent is extended or adjusted under 35 U.S.C. 154(b) by 0 days.

(21) Appl. No.: 15/153,881

(22) Filed: May 13, 2016

(65) Prior Publication Data

US 2016/0251886 A1 Sep. 1, 2016

Related U.S. Application Data

(63) Continuation of application No. 13/888,000, filed on May 6, 2013.

(51) Int. Cl.
*E06B 3/46* (2006.01)
*E05D 15/10* (2006.01)
(Continued)

(52) U.S. Cl.
CPC ..... *E05D 15/0652* (2013.01); *E05D 15/0656* (2013.01); *E05D 15/08* (2013.01);
(Continued)

(58) Field of Classification Search
CPC . E05D 15/1065; E05D 15/08; E05D 15/0608; E05D 15/10; E05D 15/0613;
(Continued)

(56) References Cited

U.S. PATENT DOCUMENTS 550,339 A 11/1895 Chandler
570,711 A 11/1896 Newhall
(Continued)

FOREIGN PATENT DOCUMENTS

EP 1605125 A2 12/2005

OTHER PUBLICATIONS

Justin B Rephann, Office Action: Non-Final Rejection, U.S. Appl. No. 13/888,000, Header et al., Date of Action: Jan. 3, 2014, United States Patent and Trademark Office, Alexandria, VA US.
(Continued)

*Primary Examiner* — Justin Rephann
(74) *Attorney, Agent, or Firm* — Stone Creek Services LLC; Alan M Flum

(57) ABSTRACT

A sliding door assembly for incorporation within a wall, the assembly comprising a sliding door panel, a top rail guide and a bottom rail guide operatively associated with respective top and bottom ends of the sliding door panel to guide the same within a pair of cooperating guide tracks provided within each of the top rail guides and bottom rail guides, the top and bottom rails guides are not vertically interconnected whereby the pairs of cooperating guide tracks extend in a separate plane from that of the wall so that when the sliding door panel is fully opened it is disposed behind the wall. The invention includes a guide track that is bifurcated to provide multiple sliding door panels.

12 Claims, 17 Drawing Sheets

(51) Int. Cl.
*E05D 15/06* (2006.01)
*E06B 3/36* (2006.01)
*E05D 15/08* (2006.01)

(52) U.S. Cl.
CPC ..... *E05D 15/10* (2013.01); *E05D 15/1065* (2013.01); *E06B 3/4645* (2013.01); *E05D 2015/1026* (2013.01); *E05Y 2900/132* (2013.01); *E05Y 2900/148* (2013.01); *E06B 3/362* (2013.01)

(58) Field of Classification Search
CPC ..... E05D 15/0652; E05D 15/0656; E05D 15/1042; E05D 2015/1055; E06B 3/4645
See application file for complete search history.

(56) References Cited

U.S. PATENT DOCUMENTS 770,829 A 9/1904 Smart
840,732 A 1/1907 Wyeth
932,187 A 8/1909 Straubhaar
1,462,302 A 9/1922 Phillips
2,144,782 A 2/1936 Swanson
2,289,960 A 9/1939 Grignet
2,317,312 A 4/1943 Swanson et al.
2,657,436 A 11/1953 Fairhurst et al.
2,841,219 A 7/1958 Helwig
2,944,282 A 7/1960 Greco
3,279,123 A 10/1966 Genison
3,309,816 A 3/1967 Malone
3,334,375 A 8/1967 Hubbard
3,425,160 A 2/1969 Petterborg
3,694,959 A 10/1972 Gartner
3,708,916 A 1/1973 Karp, Jr. et al.
3,925,933 A 12/1975 Reuter
4,555,828 A 12/1985 Matimura
4,573,286 A 3/1986 Favrel et al.
4,688,352 A * 8/1987 Kinoshita ..... E05D 15/10 49/209
5,016,318 A 5/1991 Harris
5,022,454 A 6/1991 Kobayashi et al.
5,090,171 A 2/1992 Kano et al.
5,181,296 A 1/1993 Williams
5,230,123 A 7/1993 Williams et al.
5,329,857 A 7/1994 Owens
5,351,442 A * 10/1994 Gingras ..... E05D 15/1042 49/411
5,613,323 A 3/1997 Buening
6,041,551 A 3/2000 Aspenwall
6,286,258 B1 9/2001 Bischof et al.
6,286,277 B1 9/2001 Blobaum et al.
6,374,456 B1 4/2002 Fort et al.
6,438,912 B1 8/2002 Avent
6,497,072 B2 12/2002 Fries
6,516,566 B2 2/2003 Finke
6,553,715 B1 4/2003 Lonnberg
6,684,567 B2 2/2004 Heidrich et al.
6,691,462 B2 2/2004 Oestermann
6,826,867 B1 12/2004 McDonald et al.
6,848,214 B2 2/2005 Bischof et al.
7,255,045 B2 8/2007 Owens
7,584,574 B2 9/2009 Kinross et al.
7,647,728 B2 1/2010 Bortoluzzi
7,980,027 B2 7/2011 Kraus et al.
8,113,607 B2 2/2012 Slager et al.
8,297,334 B2 * 10/2012 Chu ..... E06B 9/36 160/196.1
8,375,638 B2 2/2013 Martin et al.
8,375,645 B2 2/2013 Iwauchi et al.
8,375,646 B2 2/2013 Newkirk et al.
8,381,444 B1 * 2/2013 McDonald ..... E05D 15/0608 49/213
2002/0053166 A1 * 5/2002 Fries ..... E05B 65/08 49/213
2003/0226315 A1 12/2003 Haab et al.
2007/0277442 A1 12/2007 Dery et al.
2008/0100093 A1 5/2008 Seiple et al.
2010/0050530 A1 3/2010 Blasi
2010/0199563 A1 8/2010 Bortoluzzi
2010/0205865 A1 8/2010 Iwauchi et al.
2010/0281931 A1 11/2010 Slager et al.
2014/0013685 A1 * 1/2014 Coleman ..... E04B 2/88 52/235

OTHER PUBLICATIONS

Justin B Rephann, Office Action: Final Rejection, U.S. Appl. No. 13/888,000, Header et al., Date of Action: Jul. 1, 2014, United States Patent and Trademark Office, Alexandria, VA US.
Justin B Rephann, Office Action: Non-Final Rejection, U.S. Appl. No. 13/888,000, Header et al., Date of Action: Feb. 9, 2015, United States Patent and Trademark Office, Alexandria, VA US.
Justin B Rephann, Office Action: Final Rejection, U.S. Appl. No. 13/888,000, Header et al., Date of Action: Oct. 27, 2015, United States Patent and Trademark Office, Alexandria, VA US.
Justin B Rephann, Notice of Allowability, U.S. Appl. No. 13/888,000, Header et al., Date of Document: Apr. 6, 2016, pp. 1-6, United States Patent and Trademark Office, Alexandria, VA US.

* cited by examiner

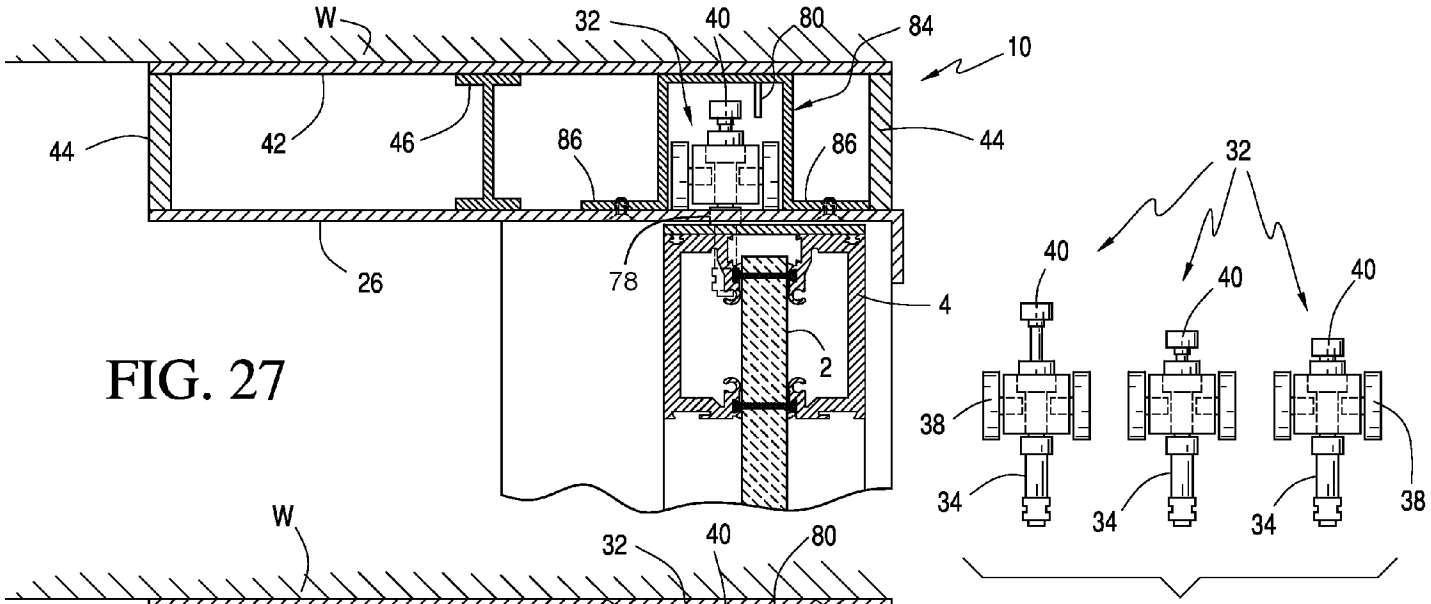
FIG. 27
FIG. 29
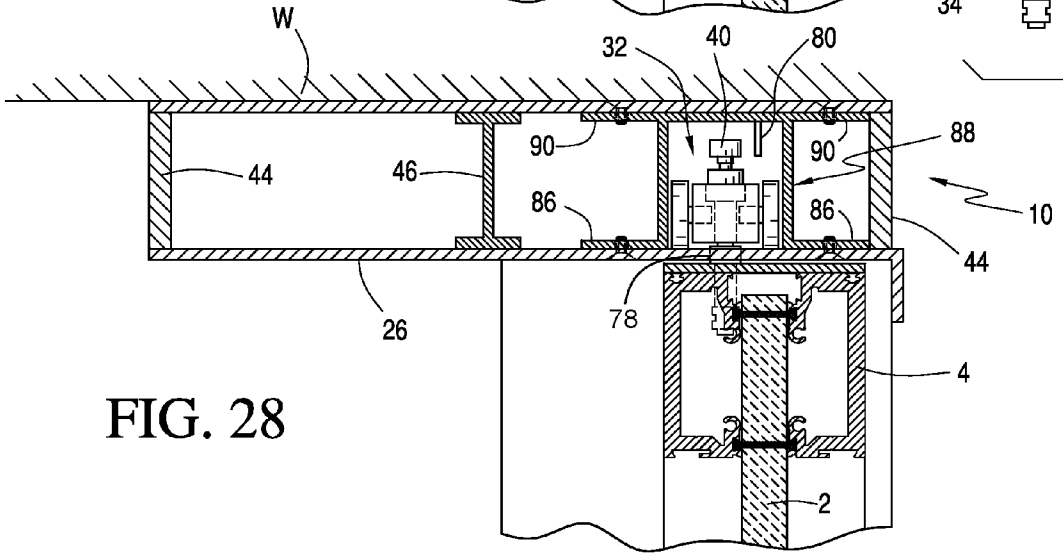
FIG. 28

SLIDING DOOR ASSEMBLY

This application is a continuation of U.S. patent application Ser. No. 13/888,000 filed on May 6, 2013. The entire contents of U.S. patent application Ser. No. 13/888,000 are hereby incorporated by reference.

FIELD OF THE INVENTION

This invention relates to sliding door panels and in particular, a sliding door assembly adapted for use within a facade or other curtain wall system.

BACKGROUND OF THE INVENTION

It is known to integrate a sliding door within a main building facade. The sliding door assemblies of the prior art generally comprise a frame member that supports the door, the frame having a width sufficient to enable the door to be opened and closed. The head and sill of the door frame are provided with guide rails connected to the top and bottom of the door. The head and sill of the frame are interconnected with by vertical support members comprising the sides of the frame. The frame enables the door to be moved laterally between a closed position in a first region of the frame and an open position in a second region of the frame. The range of movement is limited by the width of the frame.

The sliding doors assemblies of the prior art have several disadvantages. First, the top and bottom guide rails of the frame restrict the door to a relatively short area of travel. Second the door cannot pass behind the wall to which it is connected because the frame fixed within the plane as the wall. In other words, prior art sliding doors are limited in travel to region extending between the vertical frame members. This is disadvantageous because a capacity to move a sliding door outside of its frame is vital to modern facade systems.

Prior art sliding door assemblies do not provide a flush appearance with respect to wall surrounding it including the vertical mullions adjacent to it. From an aesthetic point of view, the prior art guide tracks have bulky frame members that interfere with the sight lines of the facade wall. In addition, the head rails tend to be complex in construction and difficult to incorporate within a surrounding wall. The bottom rails are not readily recessed within a floor since they are interconnected to the top rails by vertical supports.

In addition, none of the above noted prior art systems permit the use of multiple sliding doors panels operable on the same track so that the doors may be slid open and stacked behind a facade walls or moved away from each other in opposite directions.

BRIEF SUMMARY OF THE INVENTION

A sliding door assembly for incorporation within a wall, the assembly comprising a sliding door panel, a top rail guide and a bottom rail guide operatively associated with respective top and bottom ends of the sliding door panel to guide the same within a pair of cooperating guide tracks provided within each of the top rail guides and bottom rail guides, the top and bottom rails guides are not vertically interconnected whereby the pairs of cooperating guide tracks are adapted to extend in a separate plane from that of the wall to which the door assembly is mounted so that when the sliding door panel is fully opened it is disposed behind the wall.

A sliding door assembly for incorporation within a wall, the assembly comprising at least one sliding door panel, a top rail guide and a bottom rail guide operatively associated with respective top and bottom ends of the at least one sliding door panel for guiding the same within a guide track that is bi furcated, the top and bottom rails guides are not vertically interconnected whereby the guide tracks are adapted to extend in a separate plane from that of the wall to which the door assembly is mounted so that when the at least one sliding door panel is moved to a fully open position it is disposed behind the wall.

BRIEF DESCRIPTION OF THE SEVERAL VIEWS OF THE DRAWINGS

FIG. 27 is an alternative embodiment of the trolley assembly shown in FIG. 9 with portions of the door broken away;

FIG. 28 is another embodiment of the trolley assembly shown in FIG. 9 with portions of the door broken away;

FIG. 29 is a perspective view illustrating trolleys of varying height employed for use in the door assembly embodiment shown in FIG. 24;

DETAILED DESCRIPTION OF THE INVENTION

Figure 1:
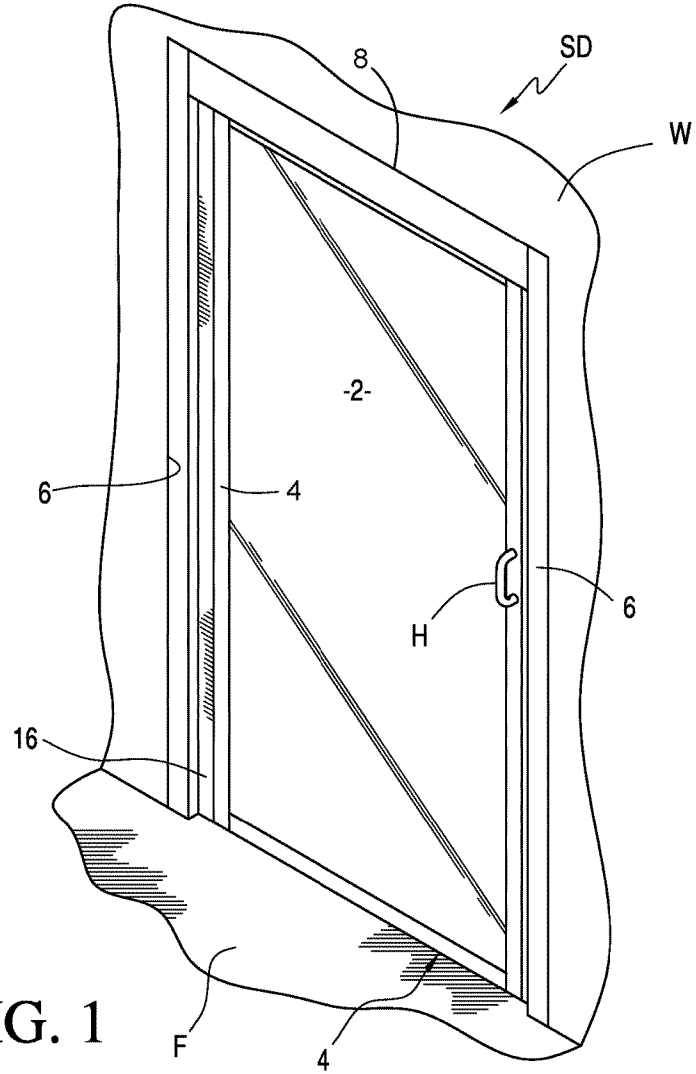
FIG. 1 is a front perspective view of the sliding door assembly embodying the present invention with the wall and floor partially shown.

A sliding door assembly SD according the present invention is illustrated in FIGS. 1 through 4 which shows a laterally movable door or panel 2 having a peripheral door frame 4 lying flush with the facade or wall W to which it is mounted. The wall W is provided with an opening formed by vertical mullions or side members 6 and a head or top member 8 defining a perimeter against which the door 2 will engage when closed and as best shown in FIG. 1.

Figure 2:
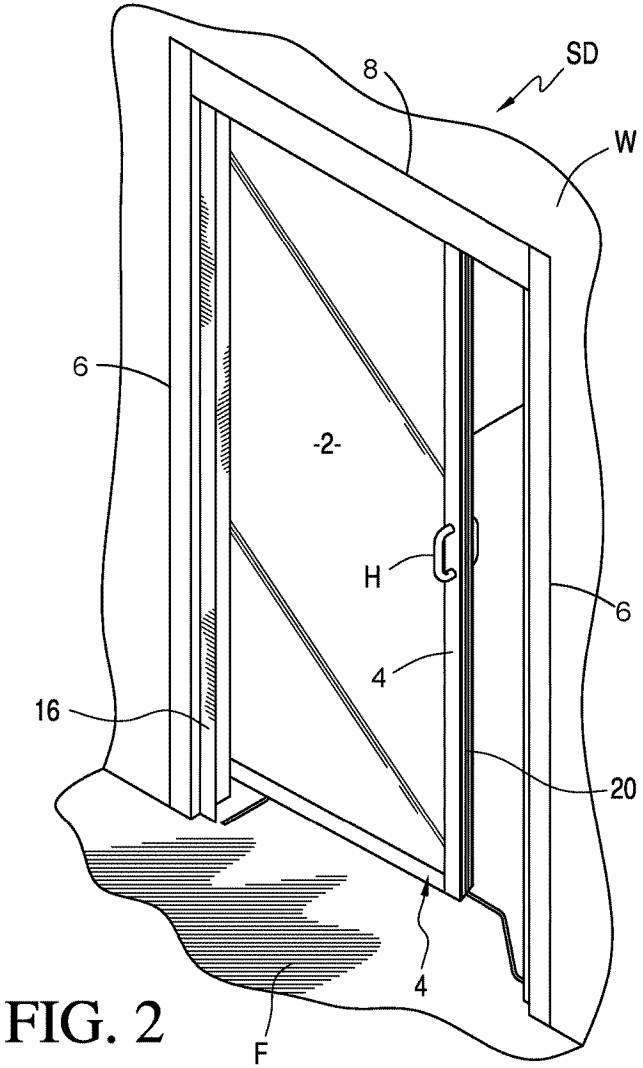
FIG. 2 is a front perspective view of the sliding door assembly shown in FIG. 1 with the door partially opened.
Figure 4:
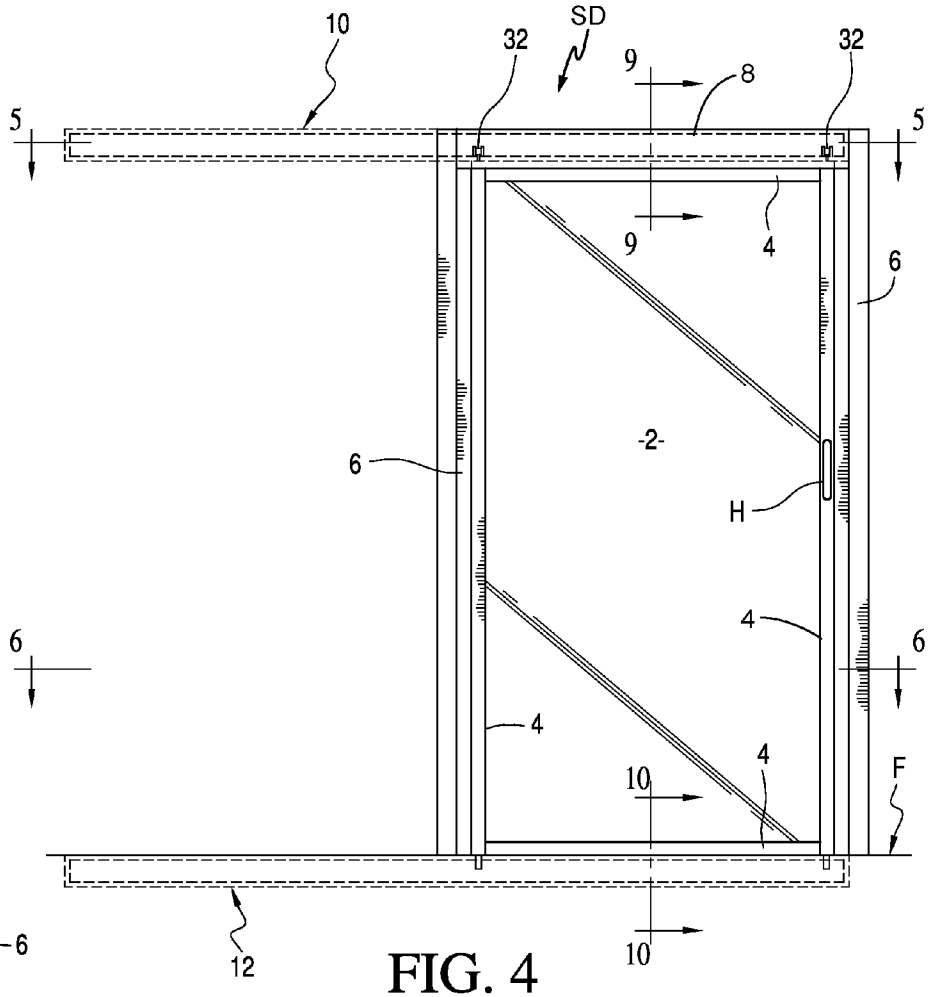
FIG. 4 is a front elevation view of FIG. 1 with portions of the assembly head and sill shown in phantom lines to expose the trolleys and guide pins respectively.
Figure 3:
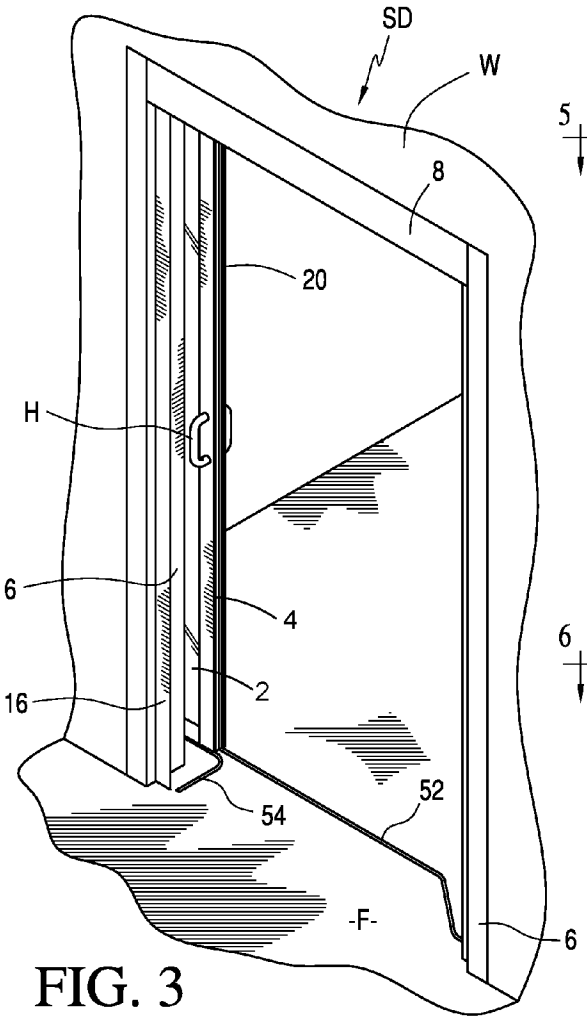
FIG. 3 is a front perspective view of the sliding door assembly shown in FIG. 1 with the door fully opened and positioned behind the wall and past the vertical end members or mullions of the assembly.

FIG. 2 illustrates the door 2 when moved into a partially opened position and FIG. 3 illustrates the door 2 moved into a fully opened position and aligned directly behind wall W and away from the side member or vertical mullion 6. In FIG. 4, a handle H is provided adjacent one side of door 2. The handle H (FIGS. 1 through 5) may include cooperating hardware for locking the door when in a closed position. FIGS. 1 and 2 also show the sliding door assembly SD in relation to the floor F.

As is apparent, the present invention is adapted for use in connection with any wall construction, whether interior or exterior including, but not limited to, facade walls, glazed walls, curtain walls and similar structures adapted to movably opened or remain fixedly closed. In addition, the present invention is not limited to doors but may include windows or other movable panels adapted for walls.

Figure 5:
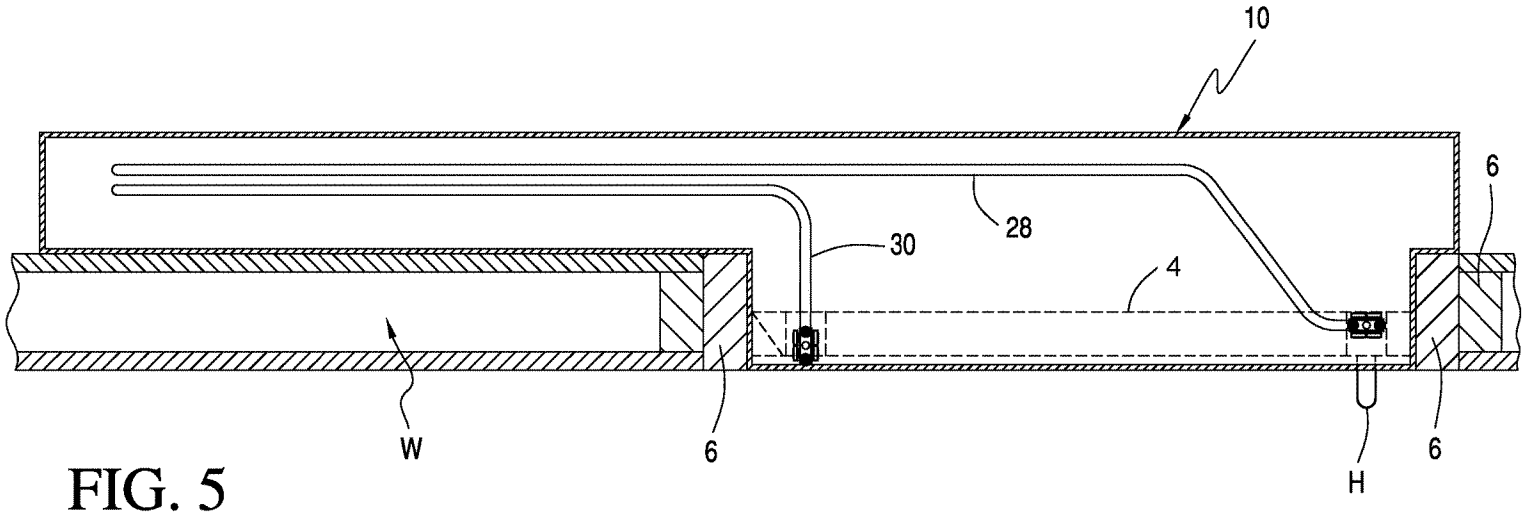
FIG. 5 is sectional view taken along lines 5-5 of FIG. 4.
Figure 6:
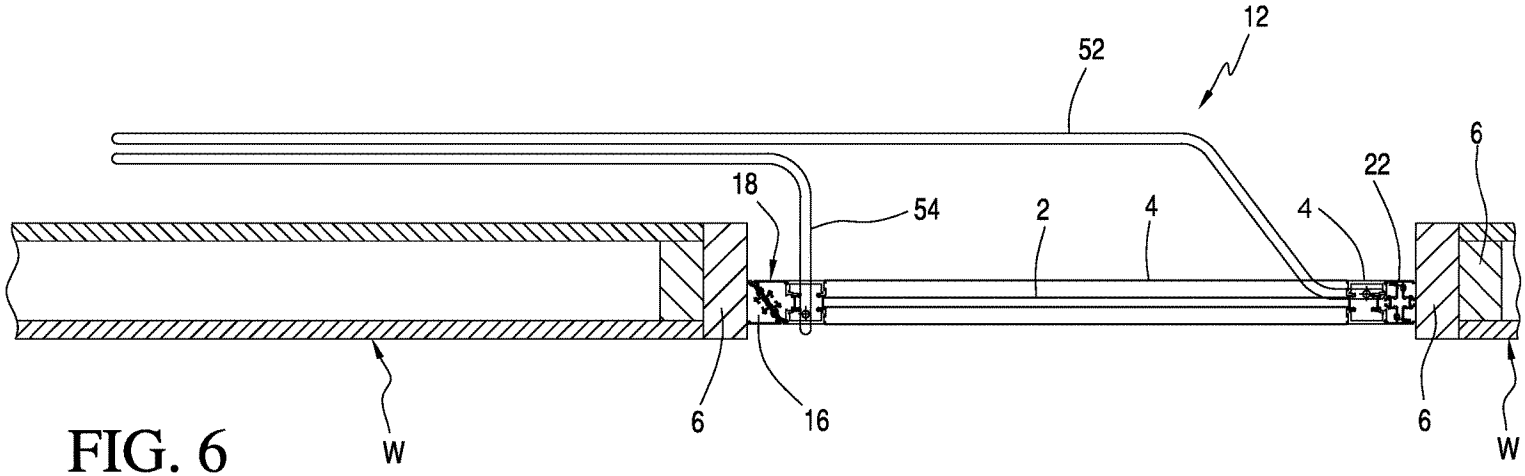
FIG. 6 is a sectional view taken along lines 6-6 of FIG. 4.

As best shown in FIGS. 4, 5 and 6, the sliding door system of the present invention is provided with a head assembly 10 (FIGS. 4 and 5) and a sill assembly 12 (FIGS. 4 and 6) that are not interconnected. The head and sill assemblies 10, 12 are shown to extend beyond the vertical mullion 6 a distance of at least the width of door 2 (FIGS. 4 and 6) to enable the door to lie completely behind wall W (FIGS. 5 and 6) when the door is fully opened. The head 10 (FIG. 5) and sill 12 (FIG. 6) are designed to withstand the full structural load of the door 2 without requiring structural interconnection. The head assembly 10 and sill assembly 12 are not limited in the distance their respective tracks may extend beyond the door opening because they are mounted independent of each other and not structurally interconnected by vertical support members or other means. Although jambs, gaskets or other seals may be installed for purposes of achieving air and/or water performance requirements, these features are not load bearing and do not affect the capacity of the assemblies to be variable in track length.

Figure 12:
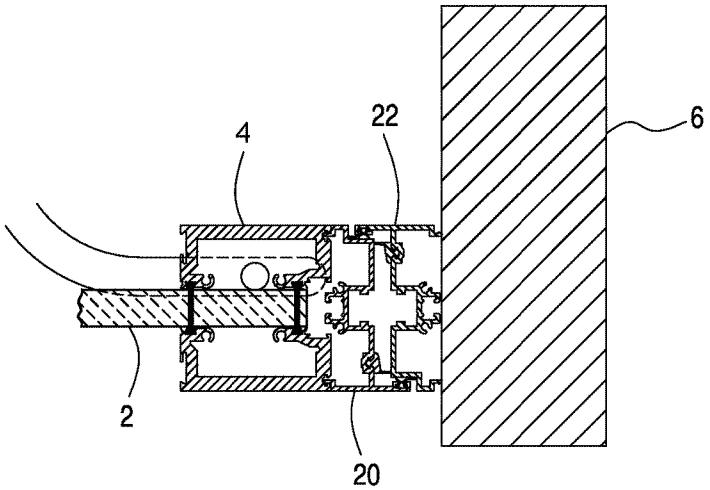
FIG. 12 is an enlarged top sectional view showing the right side of the door assembly of FIG. 6 with the track and door panels broken away and with the planar jamb shown in detail.
Figure 11:
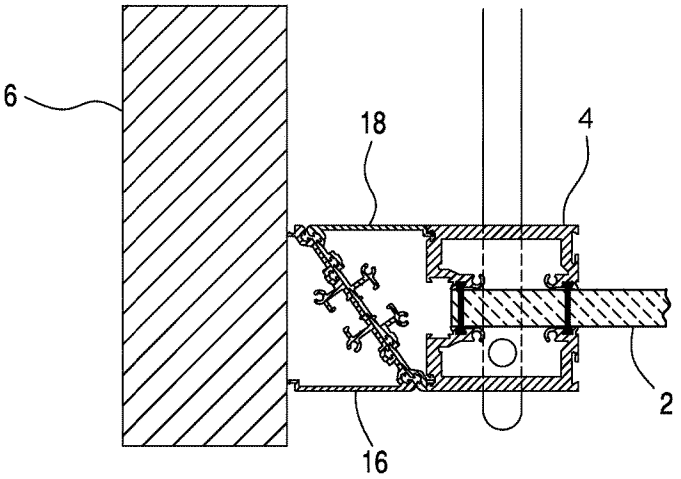
FIG. 11 is an enlarged top sectional view showing the left side of the door assembly of FIG. 6 with the track and the door panel broken away and with the tapered jamb shown in detail.

FIGS. 11 and 12 illustrate non-load supporting jamb variations for purposes of sealing the door against the side members 6. Door 2 is provided with conventional glazing to seal a glass panel to the door frame 4. FIG. 11 illustrates the left side of the door showing tapered jamb members 16, 18 that cooperate to provide a seal for the door against vertical member 6. FIG. 12 illustrates the opposite side of the door and shows straight jamb members 20, 22 that cooperate to provide a seal for the other side of the door against vertical mullions 6. Tapered jamb member 16 is also illustrated in FIGS. 1, 2, 3, 6, 7, 8, 15, 17, 18, 19, 20, 21, and 23; the tapered jamb member 18 in FIGS. 6, 7, 8, 15, 17, 19, 20, and 23; the straight jamb member 20 in FIG. 2; and the straight jamb member 22 in FIGS. 6, 7, 8, 20, and 23. Other sealing arrangements are within the scope of the invention depending upon engineering requirements.

Figure 9:
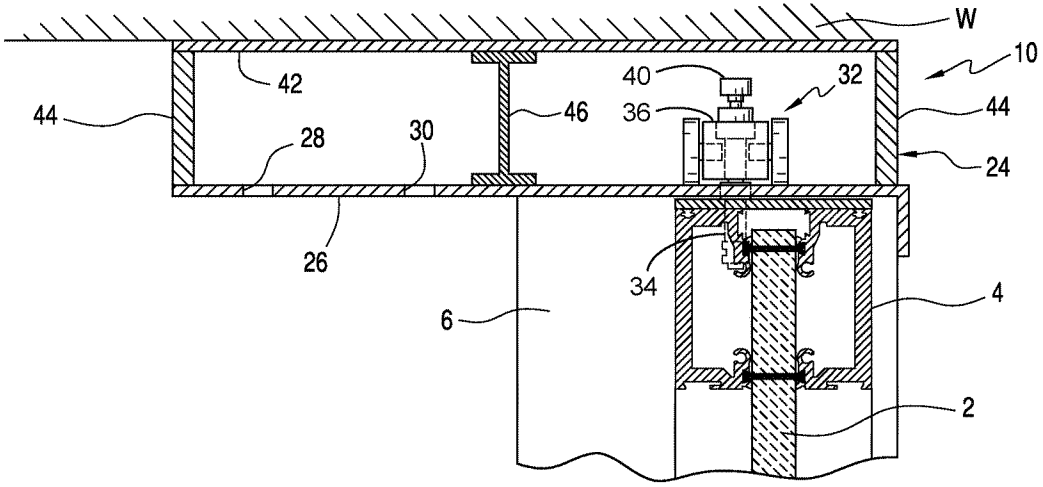
FIG. 9 is a sectional view taken along lines 9-9 of FIG. 4 with portions of the door broken away.
Figure 13:
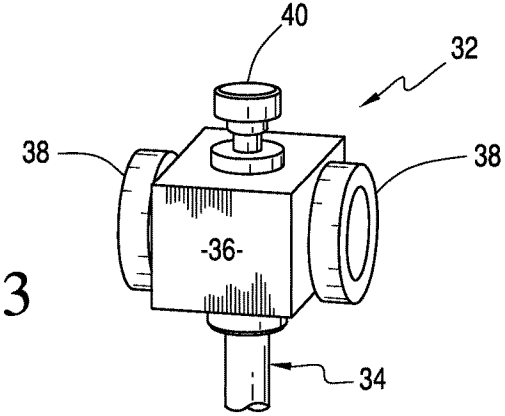
FIG. 13 is a perspective view showing the trolley roller.

FIG. 9 shows the head assembly 10 in greater detail which can be seen to comprise a housing 24 that includes a head plate 26 within which a cooperating pair of slots or guide tracks 28, 30 extend, each of the guide tracks 28 is operatively associated with one of two trolley members 32 connected to a corner portion (FIG. 4) of the frame head 10. The head assembly 10 is also illustrated in relation to the door 2 and the vertical mullion 6. As best shown in FIG. 13, trolley member 32 comprises a vertical pin 34 operatively associated with a block member 36 to enable it to rotate three hundred and sixty degrees about the axis of pin 34. The block further includes a pair of trolley wheels 38 that allow the trolley 32 to move along the path of either of tracks 28, 30 (FIGS. 5 and 9) to which it is secured. In FIG. 9, one end of pin 34 is connected to the door frame 4 with the head plate 26 extending between the door frame 4 and the trolley block 36. In FIGS. 9 and 13, the opposite end of the pin 34 terminates at guide roller or buttress 40 having a variable height as will be further explained below.

Returning to FIG. 9, the head housing 24 is shown to further include an upper plate 42 spaced a distance from the head plate 26 by vertical cover members 44 so as to provide an interior region within which the trolley members 32 may freely travel and to maintain these structures from view. A reinforcing member 46 may be provided depending upon engineering requirements and other portions of the head assembly 10 may be modified for similar reasons. For example, it is within the scope of the invention to provide a head plate 26 that is mounted directed to the wall W so that the trolley 32 is disposed interior of wall W. An impact damping device, for example an elastomeric member, may be provided in the head assembly 10 at the terminus of the track 28 30 so as to assist in stopping of the door as it reaches the end of the track 28 30. In addition, in FIG. 10, the sill plate 12 may be provided with groove or notch members and cooperating weep holes to promote water removal from the system.

Figure 10:
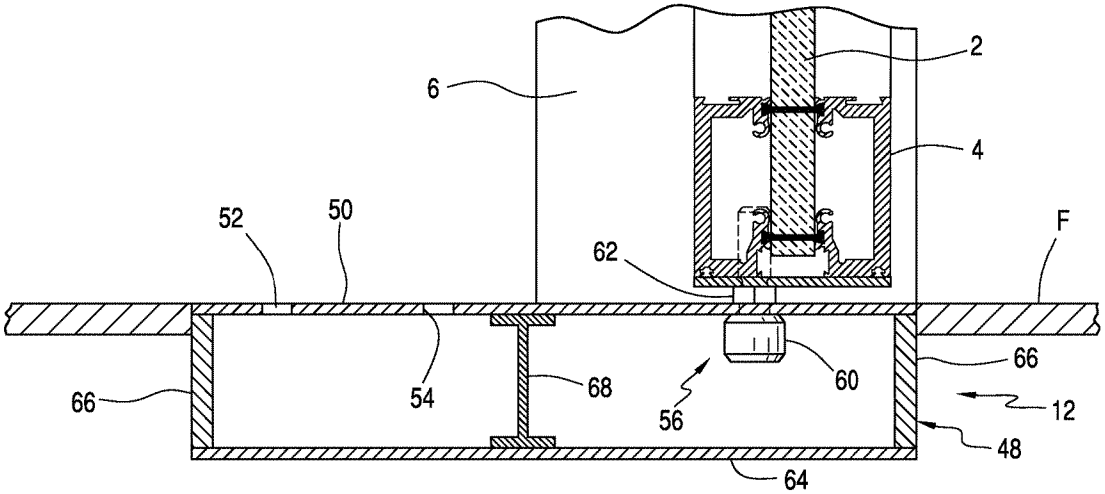
FIG. 10 is a sectional view taken along lines 10-10 of FIG. 4 with portions of the door broken away.
Figure 14:
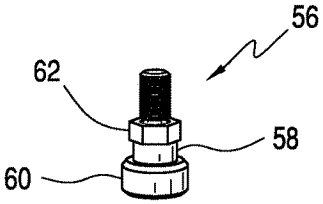
FIG. 14 is a perspective view showing the guide pin.

Turning to FIG. 10, the sill assembly 12 can be seen to comprise a housing 48 that includes a sill plate 50 within which a cooperating pair of slots or guide tracks 52, 54 extend. The shape and orientation of guide tracks 52 and 54 mirror that of guide tracks 28 and 30. Each of tracks 52, 54 is operatively associated with a guide pin 56 that is connected at one end to a corner region the frame 4 sill. The sill assembly 12 is illustrated in relation to the door 2 and the vertical mullion 6. As best shown in FIG. 14, guide pin 56 is threaded at a first end for connection to the door sill and provided with a buttress portion 60 at an opposite end below which is provided a reduced region 58, and a nut member 62. Returning to FIG. 10, the guide pin 56 is shown to extend through the guide track to which it is associated such that the sill plate 50 lies between buttress portion 60 and nut member 62 and provides a secure connection to the plate. As is apparent, the guide pin is adapted to freely travel along the associated guide track.

The sill housing 48 includes a lower plate 64 disposed in a spaced relation from sill plate 50 via vertical cover members 66 to provide an interior region within which the pair of guide pins 56 may travel. An optional reinforcing member 68 may be provided depending upon the engineering requirements of the assembly and other portions of the sill assembly may also be modified for similar reasons. For example, it is within the scope of the invention to provide a sill plate 50 that is mounted directed to the floor F so that the guide pins are recessed within the floor and without the need for a lower plate and vertical members to connect the two plates. In a preferred embodiment, the head assembly is designed as a so called top load system wherein the trolleys and the supporting structure are disposed in the head and configured to support the full load of the system. It is within the scope of the invention to provide the various head assembly components noted above within the sill assembly and provide guide pins 56 in the head assembly.

Operation of the sliding door assembly is best shown in FIGS. 1 through 3 and FIGS. 6 through 8 of the drawings. FIGS. 1 and 6 illustrate the door assembly when in a closed position with door 2 flush with the facade W to which it is mounted and with the door positioned between the side members or vertical mullions 6.

Figure 7:
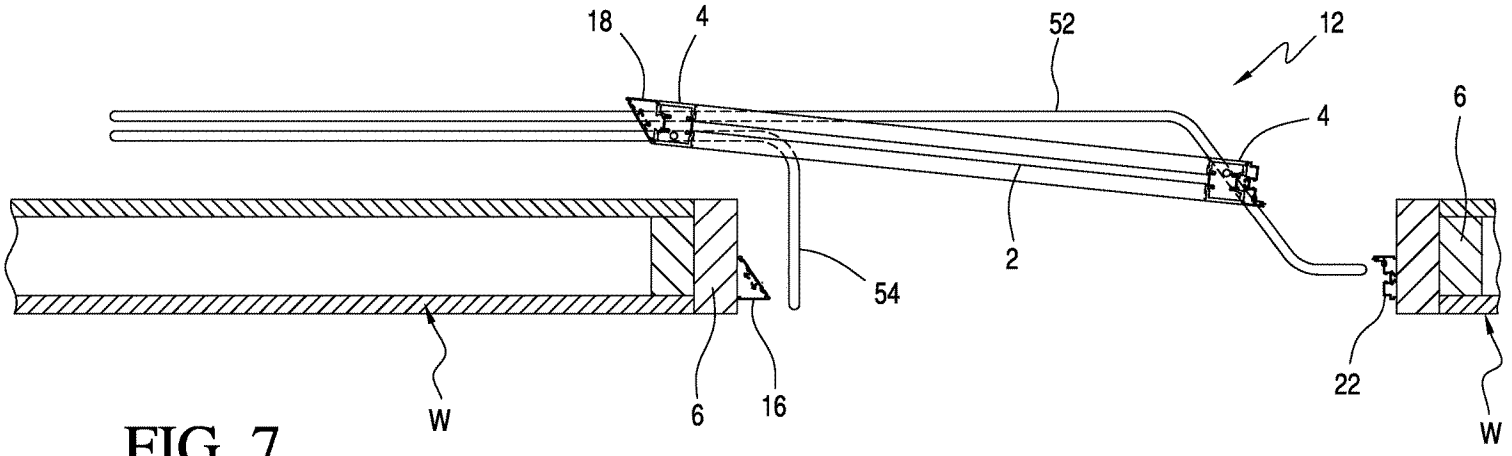
FIG. 7 is the sectional view of FIG. 6 but showing the door partially opened.
Figure 8:
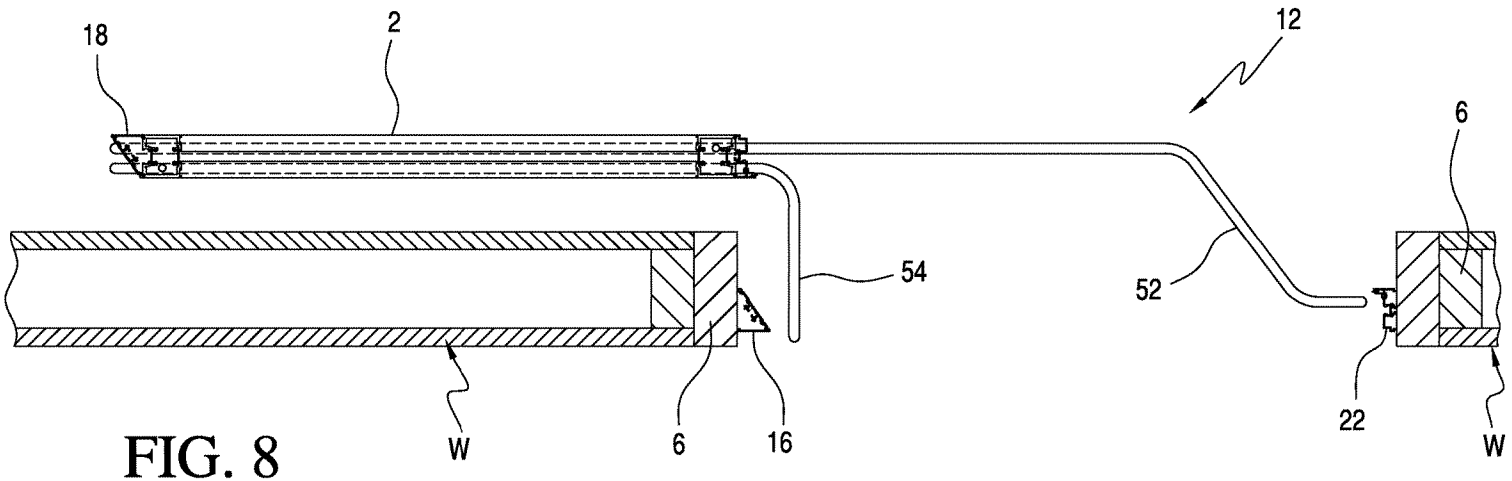
FIG. 8 is the sectional view of FIG. 6 but showing the door fully open and disposed behind the facade wall and past the vertical end members or mullions.

When handle H is grasped and the door is unlocked, it can be moved laterally in the manner as shown in FIG. 2. The trolley members 32 (FIG. 4), which are adapted to fully rotate about their axis, direct the door along a path of guide slots 28 and 30 of the head assembly 10 (FIG. 5) and consequently, in FIG. 6, the path of corresponding guide slots 52 and 54 disposed in the sill plate 12. FIG. 7 shows the alignment of the door 2 as it is moved beyond vertical mullion 6 and into a separate plane from that of wall W. FIGS. 5 and 6 also show the door frame 4 in top plan view with hidden lines in FIG. 5 shown as broken lines. FIGS. 7 and 8 show the guide tracks 52 54 in cooperative relation with the door 2, the door frame 4, tapered jamb members 16 18, straight jamb member 22, vertical mullion 6, sill assembly 12, and the wall W. FIG. 3, guide tracks 52 54 are shown in relation to the wall W and the floor F. FIGS. 3, 5, and 6 illustrates the door in a fully opened position and where the trolleys 32, of FIG. 4, and guide pins 56 of FIG. 10, have reached the terminus of the guide slots. The fully opened door is now parallel to directly behind wall W.

Figure 15:
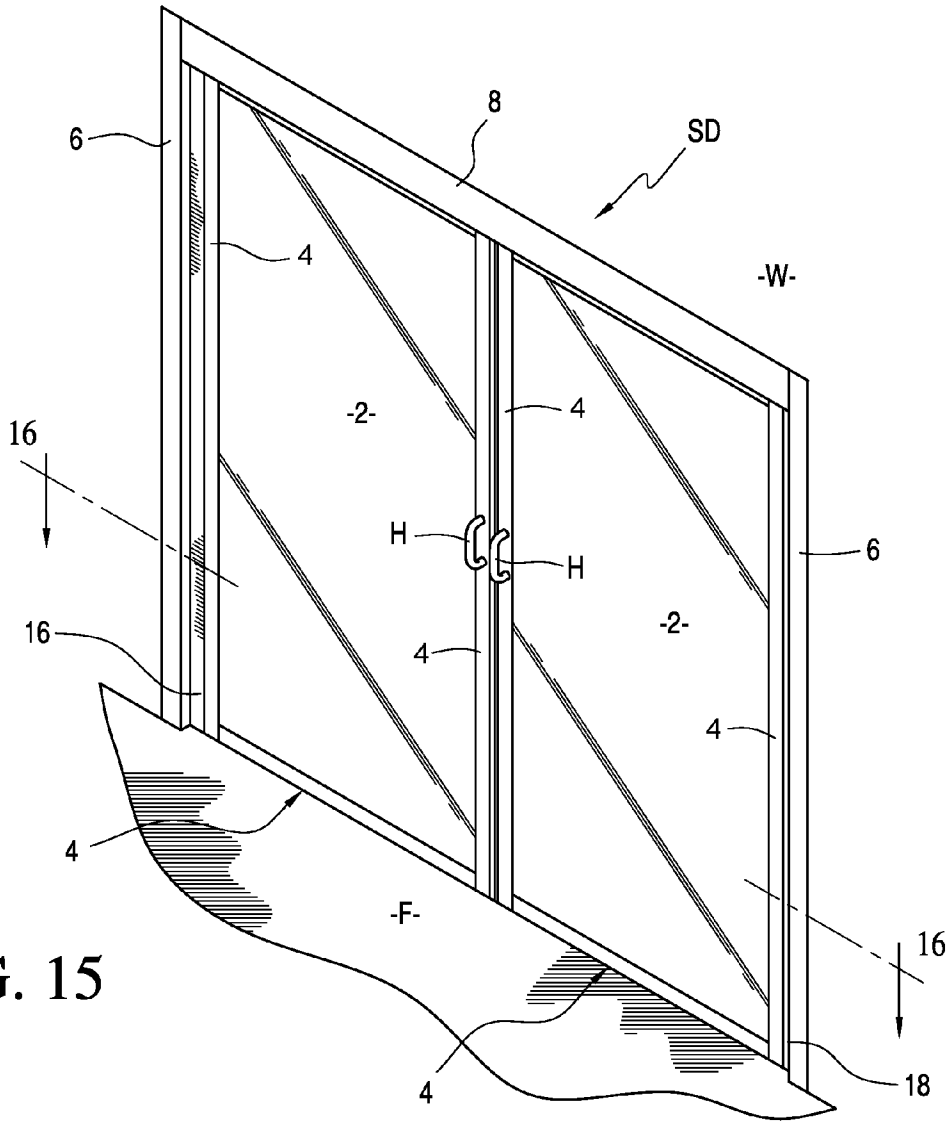
FIG. 15 is a front perspective view of another embodiment of the sliding door assembly according to the present invention with the wall and floor partially shown.
Figure 16:
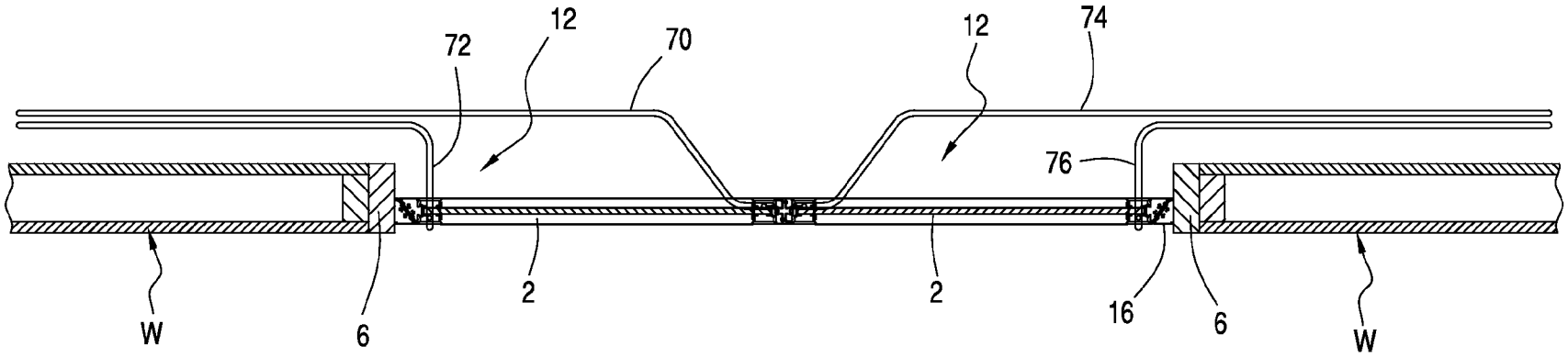
FIG. 16 is a sectional view taken along lines 16-16 of FIG. 15.
Figure 17:
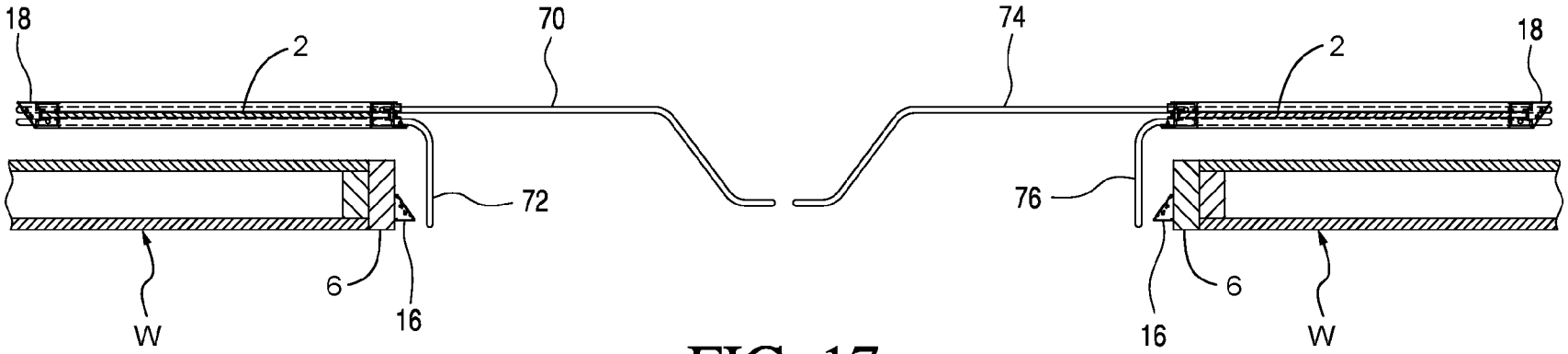
FIG. 17 is the sectional view of FIG. 16 but showing the French doors fully opened.

FIGS. 15 through 17 illustrate another embodiment of the present invention whereby a pair of sliding doors are aligned in the manner of French doors that when opened are adapted to move apart from each other in opposite directions and beyond their respective vertical mullions 6 and into a position behind the wall W. Reference numerals identifying structure in this and subsequent embodiments will correspond to the reference numbers for similar or the same structures in the previous embodiment except where otherwise noted.

FIG. 15 illustrates the sliding door assembly SD including a pair of laterally movable doors 2, each of which is provided with a peripheral door frame 4 to contain a glass or other panel and lie flush with the facade or wall W to which it is mounted. The wall W is provided with an opening formed by vertical mullions or side members 6 and a head or top member 8 that defines a perimeter against which the doors 2 will engage in a flush manner when in a closed position as shown in FIG. 1. A head assembly (not shown) is provided in the manner as described in the previous embodiment. As best shown in FIG. 16, a cooperating sill assembly is provided for each of the doors and neither the head nor sill assemblies are interconnected.

In FIGS. 15, 16, and 27, the head and sill assemblies extend beyond their respective vertical mullions 6 a distance of at least the width of doors 2 to enable the doors to lie completely behind wall W when fully opened. As in the earlier embodiment, the head and sill are designed to withstand the full structural load of the door without requiring structural interconnection. The head and sill assemblies are not limited in the distance their respective tracks may extend beyond the door opening because they are mounted independent of each other and not structurally interconnected by vertical support members or other means. Although jambs, gaskets or other seals may be installed for purposes of achieving air and/or water performance requirements, these features are not load bearing and do not affect the capacity of the assemblies to be variable in track length.

Turning to FIGS. 16 and 17, each of the sill assemblies is shown to include a cooperating pair of slots or guide tracks 70, 72, 74, 76 respectively, that mirror the guide tracks of the corresponding head assembly (not shown). As noted earlier for FIG. 9, each of the head assembly guide tracks is operatively associated with one of two trolley members 32 connected to a corner portion of the frame 4 head. The sill assembly 12 of FIG. 16 and guide tracks 70, 72, 74, 76 are similarly associated with guide pins as earlier described.

As illustrated in FIG. 15, when the door handles H are grasped and the doors 2 are caused to be unlocked, they may be moved laterally and in opposite directions as shown in FIG. 17. The trolley members fully rotate about their axis to direct the doors along respective guide slots of the head assembly (not shown) and the sill assembly 12 (FIG. 16). FIG. 15 also shows the sliding door assembly SD in relation to the floor F. FIG. 17 shows the alignment of the doors 2 after it has been moved beyond vertical mullion 6 and into a separate plane from that of wall W and into a fully opened position and where the trolleys and guide pins have reached the terminus of their guide slots. The fully opened doors are now parallel to directly behind wall w.

Figure 18:
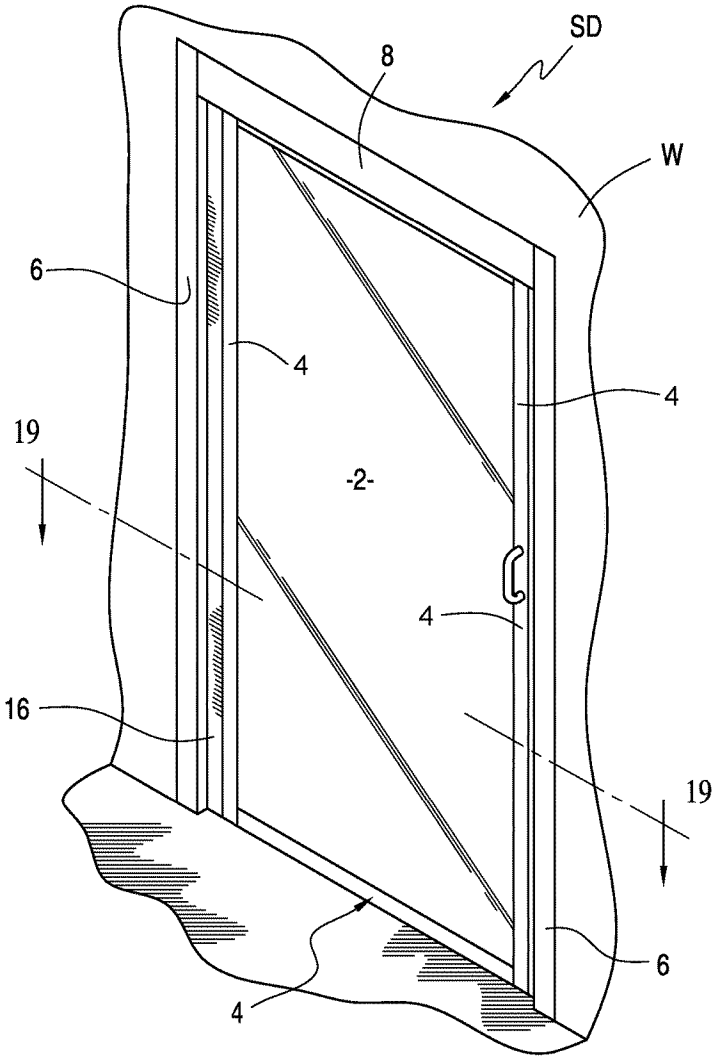
FIG. 18 is a front perspective view showing another embodiment of the present invention with the sliding door shown in a closed position and where the wall and floor is partially shown.
Figure 19:
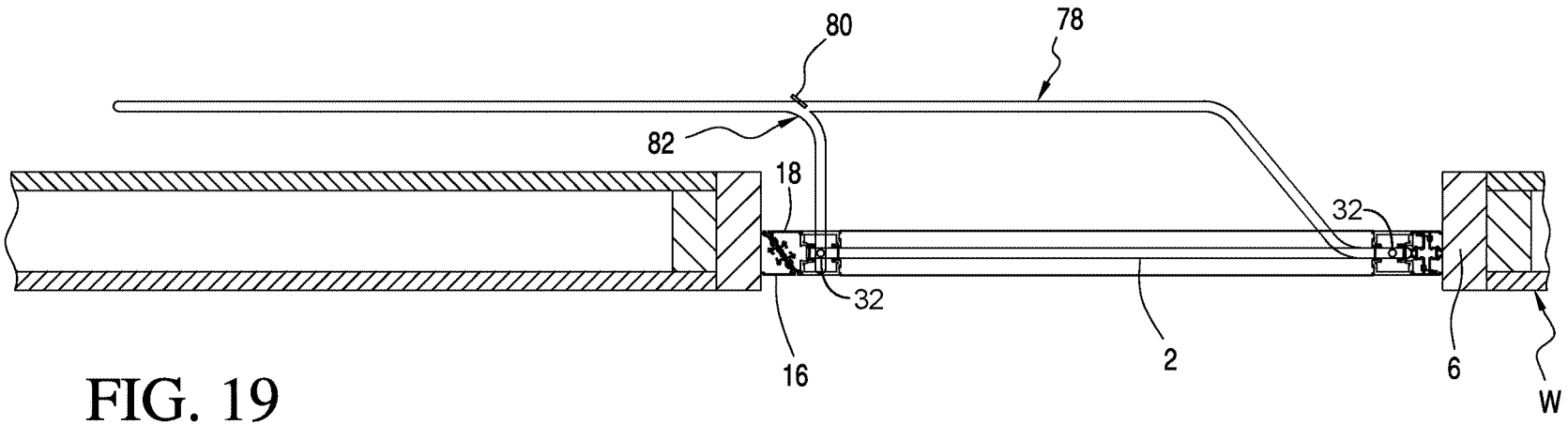
FIG. 19 is a sectional view taken along lines 19-19 of FIG. 18 and illustrating the single track for guiding both pins of the door panel.
Figure 20:
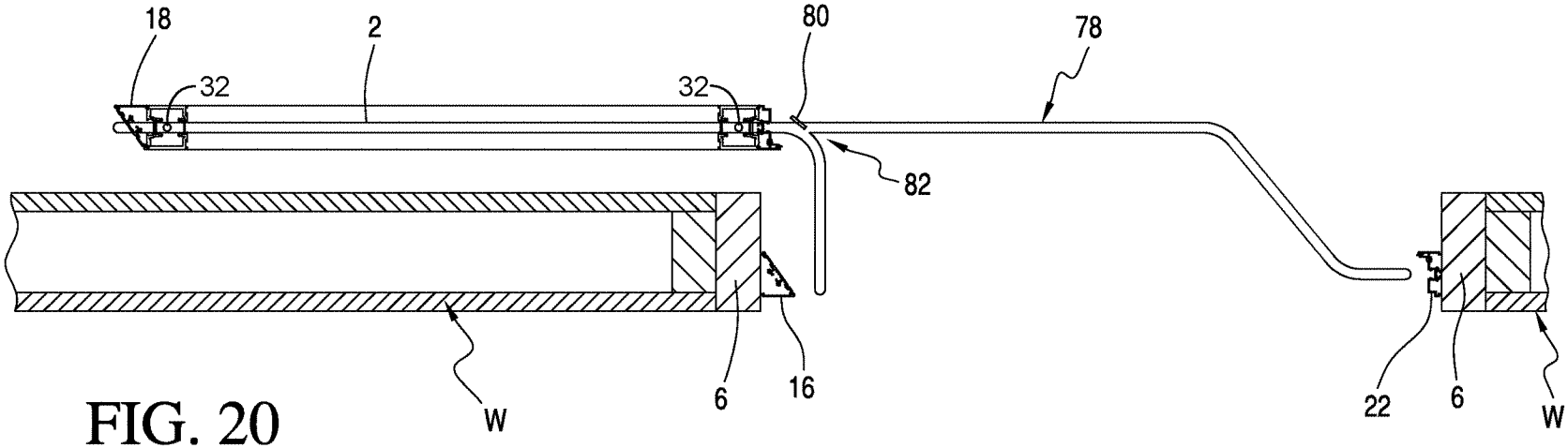
FIG. 20 is the sectional view shown in FIG. 19 but showing position of the door when fully opened and disposed behind the wall and past the vertical mullions or end members.

FIGS. 18 through 20 and 27 illustrate another embodiment of the invention whereby a single guide track that is bifurcated is utilized in each of the head and sill assemblies. FIG. 18 illustrates the door 2 for this embodiment in a fully closed position and FIGS. 19 and 20 show the single guide track 78 associated with this embodiment and their placement in relation to the vertical mullions 6 and the wall W. In particular, the single guide track 78 may be provided with a deflector plate 80 at guide track juncture 82, the deflector plate having height that corresponds to the height of the trolley pins 34 to be deflected. FIG. 18 shows the sliding door assembly SD including the top member 8, door frame 4, in combination with the vertical mullions 6, and the wall W.

FIG. 27 illustrates a reinforced head assembly associated with the bifurcated single track embodiments. In particular, the head assembly 10 is provided with a hat-shaped reinforcement member 84 having the deflector plate 80 secured to an interior surface of the reinforcement member 84. The reinforcement member 84 is provided with flange portions 86 to secure the reinforcement member 84 to the head plate 26 and above track 78 at juncture 82 (not shown) to reinforce the same.

FIG. 28 illustrates another reinforced head assembly embodiment adapted for use with a single guide track that is bifurcated. In this embodiment, the head assembly 10 is provided with a C-channel reinforcement member 88 having the deflector plate 80 secured to an interior surface of the reinforcement member 88. The reinforcement member 88 is provided with lower flange portions 86 as well as upper flange portions 90 to secure the reinforcement member 88 to the head plate 26 and above track 78 at juncture 82 (not shown) to reinforce the same. FIG. 28 also shows the interrelation between the door 2, the door frame 4, the reinforcing member 46, the vertical cover members 44, the trolley members 32, the guide rollers 40, and the wall W.

Returning to FIGS. 19 and 20, the bifurcated track 78 embodiment with deflector plate 80 operates as follows. As door 2 is moved laterally, the trolley members 32 and guide pins 56 (not shown) will guide the door along the single guide tracks associated with the head and sill assemblies. When the trolley member 32 associated with one end of door 2 reaches track juncture 82 it will continue in a direction toward the end of the track. However, referring to FIG. 27, providing a deflector plate 80 for contact against the buttress or guide roller 40 of the trolley 32 will ensure the guide roller 40 will continue in a direction toward the end of the track 78 (FIG. 20) and a fully opened position of the door. Conversely, the guide roller 40 (FIG. 27) of the other trolley member 32 associated with the opposite end of door 2 of FIGS. 19 and 20 has a reduced height (FIG. 29) so that when it approaches deflector 80, it will not contact against it but freely pass by and thereby enable the door to continue moving laterally and into a fully open position located behind wall W. This is shown in FIG. 20 of the drawings. Although the deflector plates are not necessary for the invention to function, it has been found to improve operation of the system and ease movement of the door in some instances.

Figure 21:
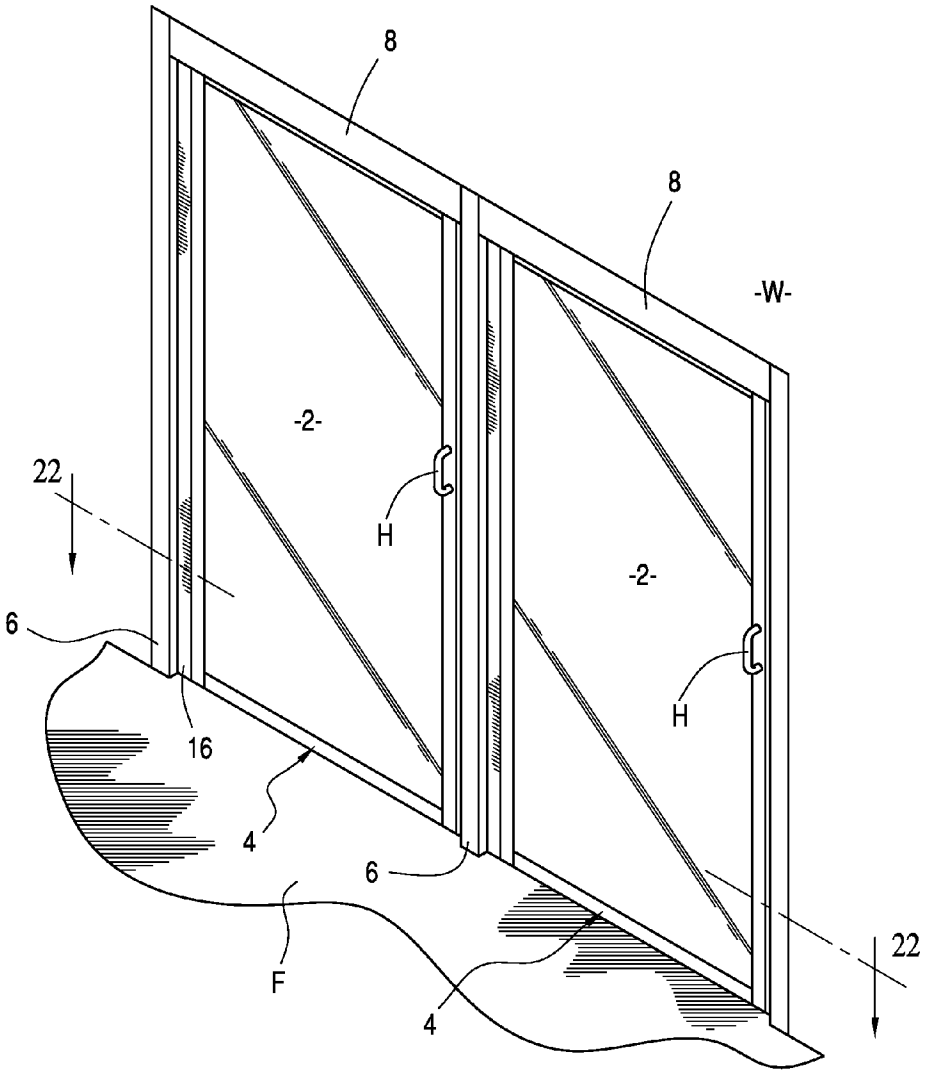
FIG. 21 is a front perspective view of another embodiment of the present invention with two sliding door shown in a closed position and where the wall and floor is partially shown.
Figure 22:
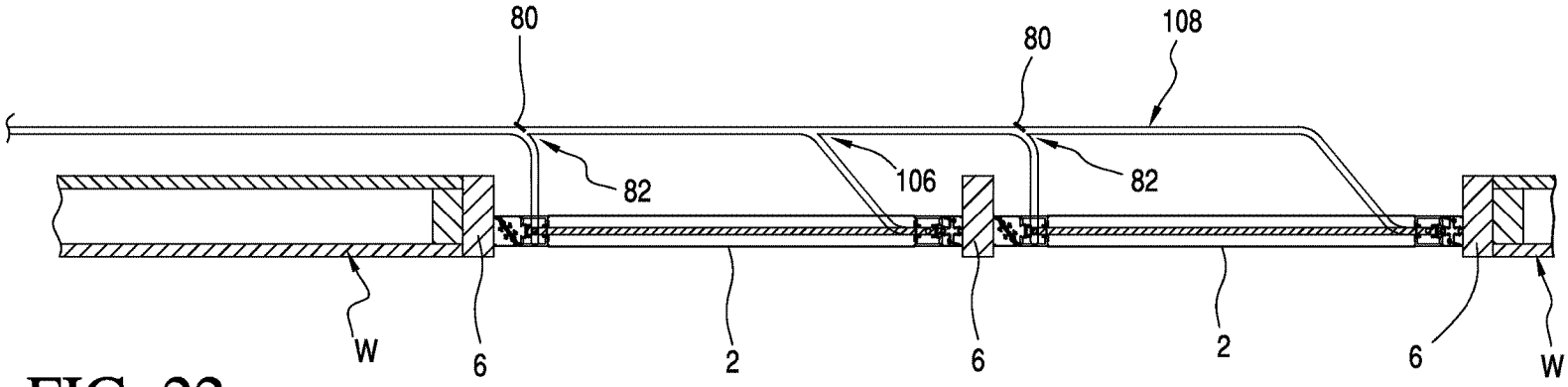
FIG. 22 is a sectional view taken along lines 22-22 of FIG. 21 and illustrating the single track for guiding both door panels into a stacked position behind the wall.
Figure 23:
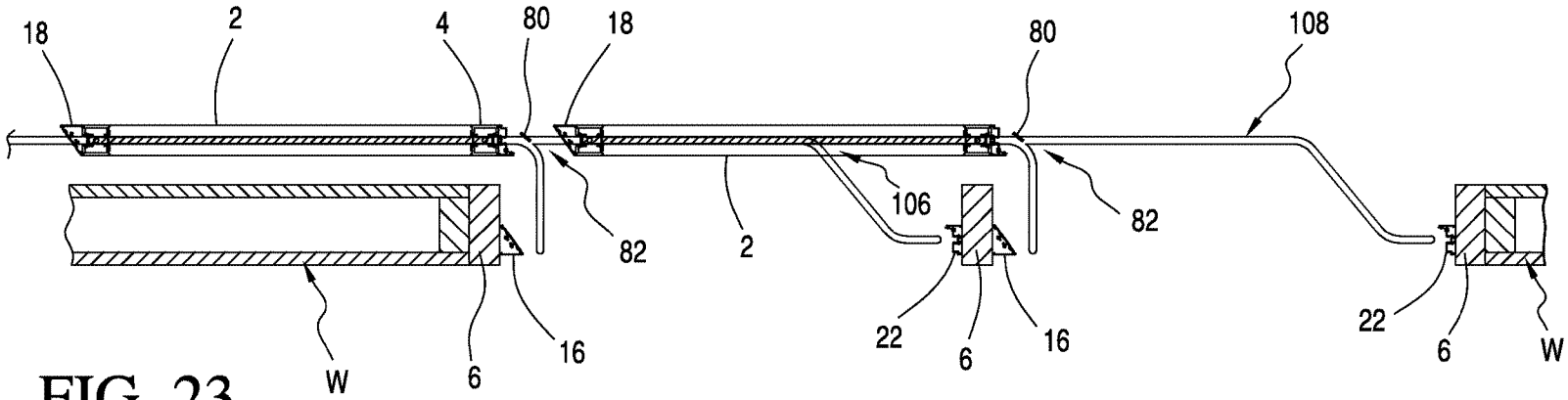
FIG. 23 is the sectional view shown in FIG. 22 but showing the first door moved to an open position behind the wall and a second door aligned on the same track so that it can be stacked against the first door to move it further along the track.

FIGS. 21 through 23 illustrate an embodiment of the assembly similar to FIGS. 18 through 20 but, as shown in FIGS. 22 and 23, where two doors are laterally movable on a single guide track 108 that is bifurcated and provided with deflector plates 80 at junctures 82. Juncture 106 does not have a deflector plate 80. The deflector plates 80 operate in the manner as described in the earlier embodiments; namely, to enhance ease of operation whereby the trolleys are urged along a path from the branch portion of the guide track and onto to the main portion of the guide track. FIGS. 21 and 22 illustrate the doors 2 in a closed position and FIG. 23 shows the doors 2 and the door frame 4 in an open position whereby one of the two doors 2 is moved beyond each of the vertical mullions 6 and into a separate plane behind wall W. The remaining door 2 may be further moved laterally so that it is also disposed behind wall W and so that both doors are behind the wall and in a stacked relation. FIG. 21 shows the door 2 and the door frame 4 in the closed position and in relation to the header assembly 8, the wall W, and the floor F.

Figure 24:
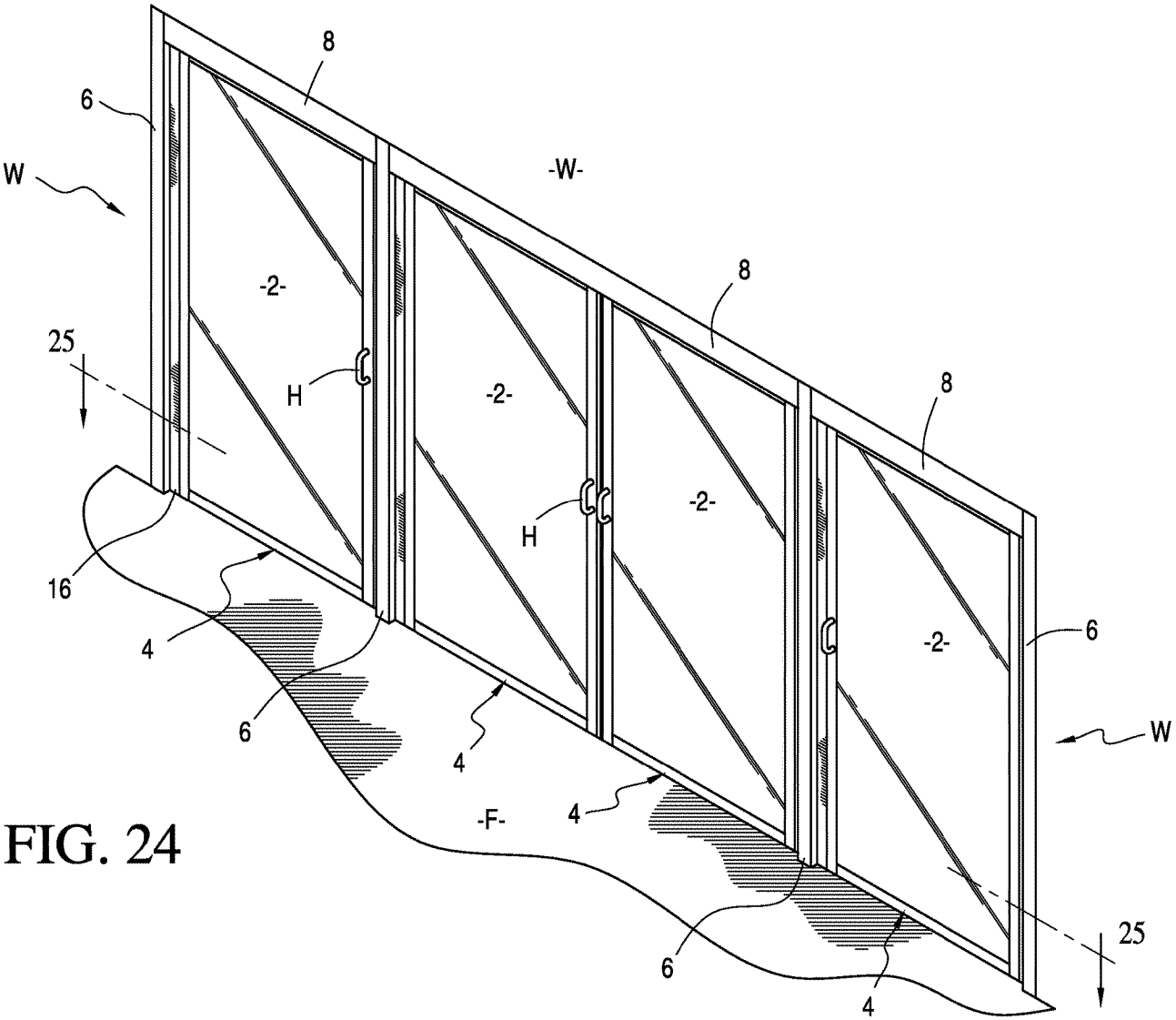
FIG. 24 is a front perspective view of another embodiment of the present invention having several sliding door shown in a closed position and where the wall and floor is partially shown.
Figure 25:
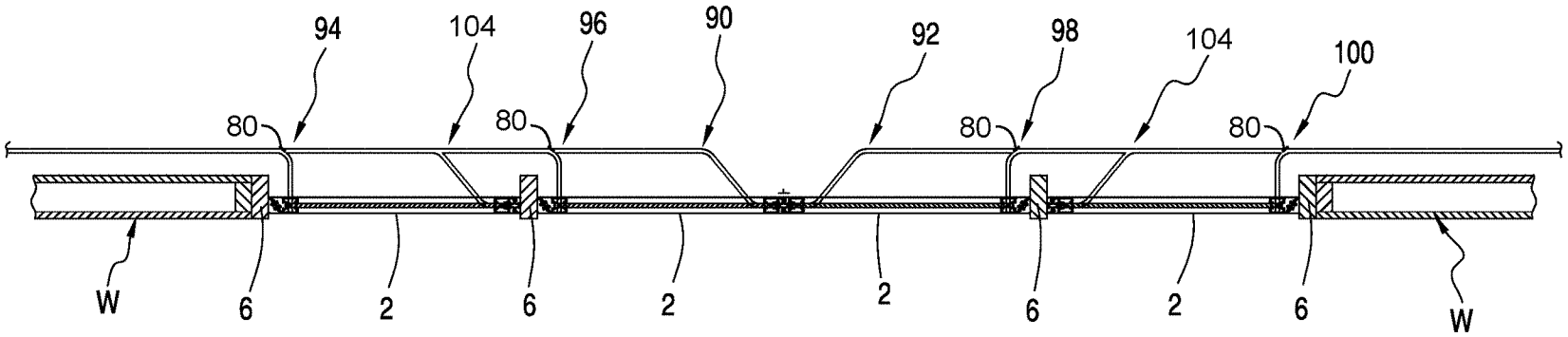
FIG. 25 is a sectional view taken along lines 25-25 of FIG. 24.
Figure 26:
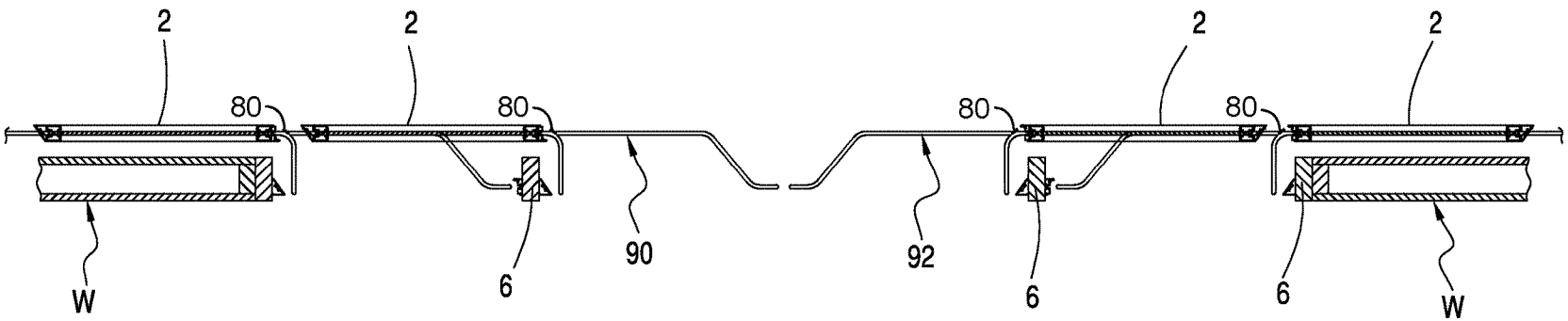
FIG. 26 is the sectional view shown in FIG. 25 but where two of the doors shown in an open position behind the wall and a second pair of doors are aligned on the same track for stacking against the first pair of doors.

FIGS. 24 through 26 illustrate another single guide track embodiment of the present invention and where multiple bifurcations are utilized in each of the head and sill assemblies to permit a French door arrangement as described earlier with respect to FIGS. 15 through 17 but where more than two doors are provided.

FIG. 24 illustrates four separate doors 2 in a fully closed position and FIGS. 25 and 26 show the arrangement of the single guide track 90, 92 in combination with the doors 2, the door frame 4, and in relation to the wall W, floor F, and the vertical mullions 6 for this embodiment. As is apparent, it is within the scope of this embodiment to provide additional doors 2. The single guide tracks 90, 92 are shown to be provided with a deflector plate 80 at guide track junctures 94, 96, 98 and 100 (FIG. 25) and for the reasons as earlier stated. Note that junctures 102 and 104 (FIG. 25) do not include guide plates. As in the earlier embodiment, the deflector plates have a height corresponding 'to the height of the trolley pins 34 (FIG. 29) to improve ease of operation whereby the pins will continue in a direction from the bifurcated track portions to the main track portions while the trolleys having shorter pins pass by the deflector plates without contact.

In operation, the handles H of the pairs of opposing doors 2 are grasped and caused to be unlocked so that they may begin to be moved laterally and in opposite directions as shown in FIG. 26. As with the other embodiments, the trolley members fully rotate about their axis to direct the doors along respective guide slots of the head assembly and the sill assembly. FIG. 26 shows the alignment of two of the doors 2 after they have been moved beyond each of the vertical mullions 6 and into a separate plane from that of wall W and in a fully open position. The remaining pairs of doors 2 may continue to be moved laterally so that they are also disposed behind wall W.

Figure 30:
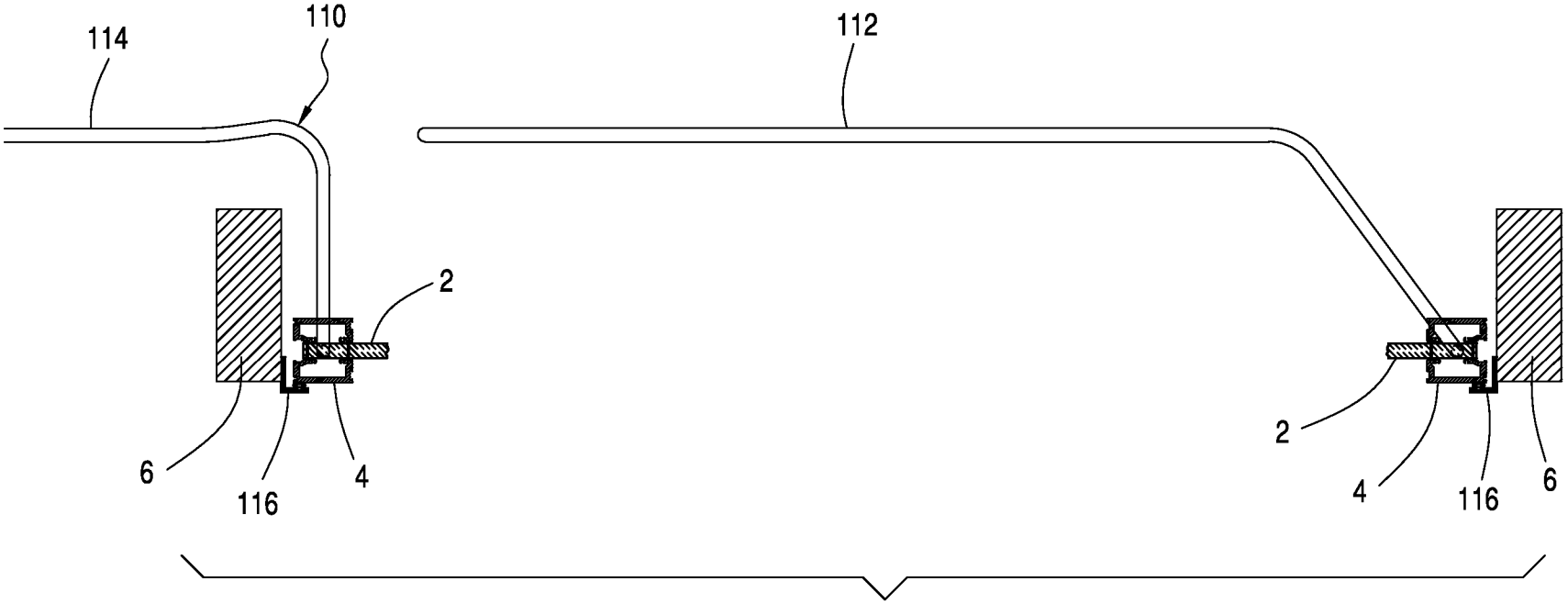
FIG. 30 is an alternative embodiment of the invention that is adapted for a low moisture environment.
Figure 31:
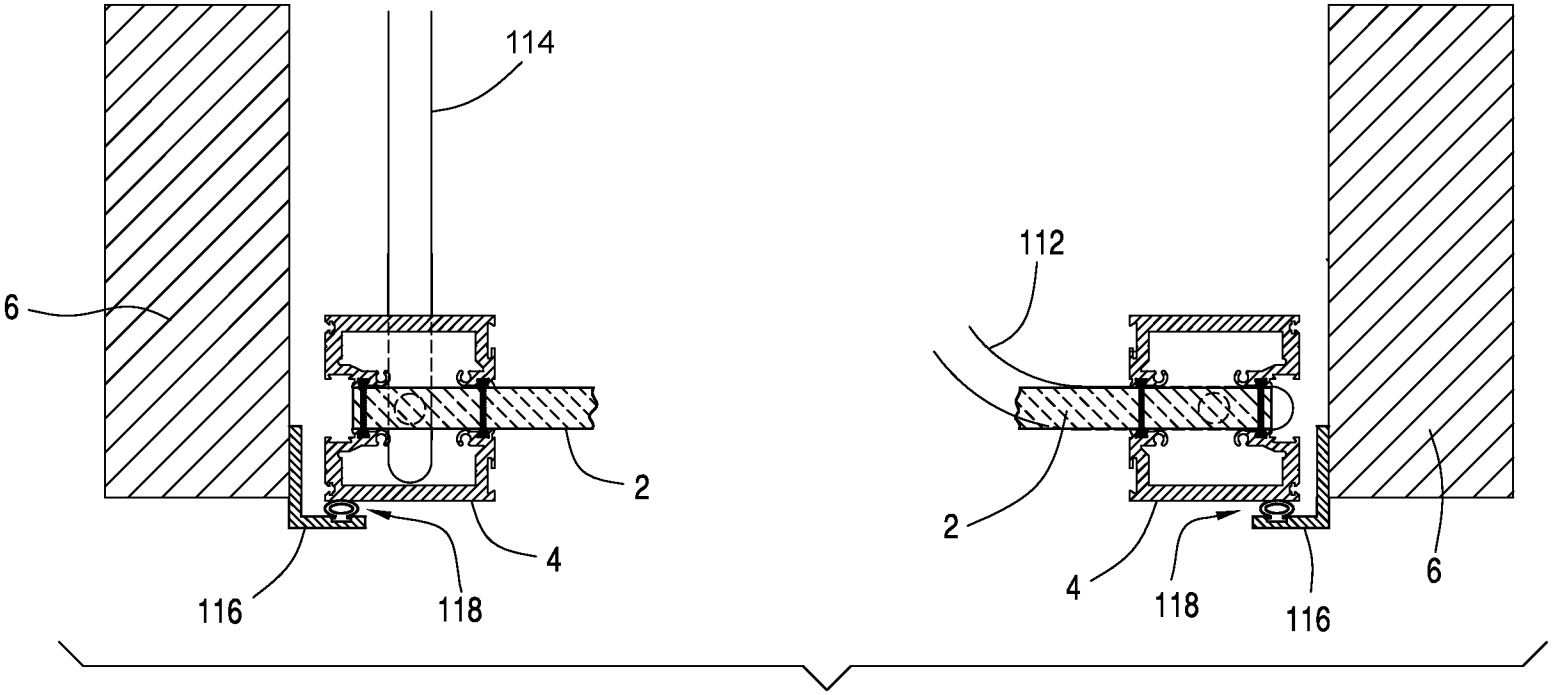
FIG. 31 is an enlarged top sectional view showing the left and right sides of the door assembly shown in FIG. 30 with the tracks and door panels broken away and with the low moisture environment jambs shown in greater detail.

FIGS. 30 and 31 illustrate another embodiment of the invention whereby dual tracks 112, 114 are provided and configured such that angled jambs are not required. In addition, the bump region 110 in track 114 reduces the forces necessary to operate the door. In this embodiment, the door frame 4 is urged into contact against an L-shaped member 116 with a gasket 118 (FIG. 31) disposed between the door frame 4 and member 116. In both FIGS. 30 and 31, the tracks 112 114 are illustrated in relation to the vertical mullions 6, as well as the door frame 4 and the door 2.

While this invention has been described as having a preferred design, it is understood that it is capable of further modifications, uses and adaptations, both in whole and in part, while following the general principle of the invention and including such departures from the present disclosure as is known or customary practice in the art to which this invention pertains, and as may be applied to the central features of this invention.

What is claimed is:

1. A sliding door assembly for a doorway opening, comprising:

a head assembly spanning the doorway opening and including a head plate comprising a separate sheet member and defining a bottom surface of the head assembly;

the head plate including a top planar surface and a bottom planar surface spanning the doorway opening, and a slot therethrough;

the slot including a linear portion, a curved portion, and slot ends, the curved portion partially traversing an area between opposing front and back edges of the head plate;

a door;

a trolley constrained to move only along the slot and bound by the slot ends, the trolley including a pin secured to and extending upward from the door and extending through the slot, and a pair of wheels constrained to roll on the top planar surface with the slot and the pin positioned therebetween; and a reinforcement member, separate from the head plate and positioned within an interior portion of the head assembly, the reinforcement member including a top member and opposing side members extending directly downward from the top member and secured to the top planar surface inward from the opposing front and back edges of the head plate and on corresponding opposing sides of the slot with the top member and the opposing side members defining an opening for the trolley to pass therethrough.

2. The sliding door assembly of claim 1, wherein:

the head assembly further including an upper plate, parallel to the head plate and defining an upper boundary of the head assembly; and the top member secured to the upper plate.

3. The sliding door assembly of claim 2, wherein:

the reinforcement member further includes a lower flanged portion projecting directly away from the corresponding opposing sides, and the lower flanged portion secured to the top planar surface inward from the opposing front and back edges of the head plate and on the corresponding opposing sides of the slot.

4. The sliding door assembly of claim 3, wherein:

the slot is bifurcated from a juncture into a first slot portion and a second slot portion; and the lower flanged portion so positioned as to reinforce the juncture.

5. The sliding door assembly of claim 3, wherein the lower flanged portion so positioned as to reinforce the curved portion of the slot.

6. The sliding door assembly of claim 1, wherein:

the slot is bifurcated from a juncture into a first slot portion and a second slot portion; and the opposing side members so positioned as to reinforce the juncture.

7. The sliding door assembly of claim 1, wherein the opposing side members are so positioned as to reinforce the curved portion of the slot.

8. A sliding door assembly for a doorway opening, comprising:

a head assembly spanning the doorway opening and including a head plate defining a bottom surface of the head assembly and vertical cover members separate from the head plate and defining front and rear outside vertical surfaces of the cover;

the head plate including a top planar surface and a bottom planar surface spanning the doorway opening and the vertical cover members, and a slot therethrough, the slot including a linear portion, a curved portion, and slot ends, the curved portion partially traversing an area between opposing front and back edges of the head plate;

a door;

a trolley constrained to move only along the slot and bound by the slot ends, the trolley including a pin secured to and extending upward from the door and extending through the slot, and a pair of wheels constrained to roll on the top planar surface with the slot and the pin positioned therebetween; and a reinforcement member, separate from the head plate and the vertical cover members and positioned within an interior portion of the head assembly, the reinforcement member including a top member and opposing side members extending directly downward from the top member and secured to the top planar surface inward from the opposing front and back edges of the head plate and on corresponding opposing sides of the slot with the top member and the opposing side members defining an opening for the trolley to pass therethrough.

9. The sliding door assembly of claim 8, wherein:

the head assembly further including an upper plate, parallel to the head plate and defining an upper boundary of the head assembly and secured to the vertical cover members; and the top member secured to the upper plate.

10. The sliding door assembly of claim 9, wherein:

the reinforcement member further includes a lower flanged portion projecting directly away from the corresponding opposing sides, and the lower flanged portion secured to the top planar surface inward from the opposing front and back edges of the head plate and on the corresponding opposing sides of the slot.

11. The sliding door assembly of claim 8, wherein:

the slot is bifurcated from a juncture into a first slot portion and a second slot portion; and the opposing side members so positioned as to reinforce the juncture.

12. The sliding door assembly of claim 8, wherein the opposing side members are so positioned as to reinforce the curved portion of the slot.

* * * * *